US006913164B2

(12) United States Patent
Duquette

(10) Patent No.: US 6,913,164 B2
(45) Date of Patent: Jul. 5, 2005

(54) ADJUSTABLE DRAWER ORGANIZER

(76) Inventor: David Michael Duquette, 1704 Hogar Dr., San Jose, CA (US) 95124

( * ) Notice: Subject to any disclaimer, the term of this patent is extended or adjusted under 35 U.S.C. 154(b) by 181 days.

(21) Appl. No.: 10/356,015

(22) Filed: Feb. 3, 2003

(65) Prior Publication Data

US 2004/0149758 A1 Aug. 5, 2004

(51) Int. Cl.[7] ..... B65D 25/04
(52) U.S. Cl. ..... 220/528; 220/507
(58) Field of Search ..... 220/528, 507, 220/62; 229/120.38, 120.24, 120.23

(56) References Cited

U.S. PATENT DOCUMENTS 3,235,432 A * 2/1966 George ..... 156/201
3,703,326 A * 11/1972 Riviers ..... 312/348.3
4,303,354 A * 12/1981 McDowell, Jr. ..... 405/302.1
5,533,954 A * 7/1996 Zogg ..... 493/310
5,887,961 A * 3/1999 Rosenberg et al. ..... 312/348.3
6,536,654 B2 * 3/2003 Reynolds et al. ..... 229/103.11

* cited by examiner

*Primary Examiner*—Stephen Castellano

(57) ABSTRACT

A versatile drawer organizer structure for segregating a plurality of items. The structure includes a front and back wall and a blank of sheet material wherein a filler is sandwiched between a lower liner and an upper liner. The blank is folded transversely along break lines to define end walls, dividing walls and floor panels between successive walls. The blank is then adjusted in accordion fashion to the inside width of a drawer and held in that shape by attaching a front and a back wall. Thus the structure can be easily sized to precisely fit the inside width of a large number of different drawers and many other enclosed spaces.

7 Claims, 12 Drawing Sheets

10

10

10

ADJUSTABLE DRAWER ORGANIZER

BACKGROUND OF THE INVENTION

This invention relates generally to devices used to sort, segregate, and organize various items within an enclosed space.

Almost every home and business has cabinets, dressers, desks, or other similar types of furniture with drawers that pull out and can be used to hold various items. Such items may be cooking utensils, cutlery, writing implements, office supplies, and other similar items. Generally, without some type of organizer in the drawer, such items are merely thrown into the drawer (or some other enclosed space) and the user must take the time to rummage through the various items in the drawer to find one particular item.

Thus, there is a need for structures to organize drawers and other similar enclosures so that the different items can be segregated so that one particular item can be quickly and easily retrieved from the drawer. In order to segregate and organize items, which are stored in drawers as well as other enclosures, various structures have been proposed.

One approach to organizing a drawer has been to place boxes of different sizes within the drawer. This approach provides one or more compartments within the drawer in which items can be segregated. Disadvantageously, merely placing boxes in the drawer is unsatisfactory since the boxes do not fit precisely within the drawer and slide around and leave unused drawer space.

Another approach has attempted to overcome the disadvantages of placing boxes in the drawer. This approach provides one or more box like structures, which may be independently formed or formed as a unitary structure, which are cut to fit precisely within the drawer, disadvantageously, many users do not want to bother with cutting the box structure or have difficulty making accurate cuts which are necessary to provide a precise fit within the drawer or cuts which are cosmetically pleasing. Moreover, once the box structure is cut, the structure will likely not precisely fit into another drawer of different dimensions and likely cannot be altered to provide a different arrangement even in the same drawer.

In view of the above-mentioned disadvantages, it would be an advance in the industry to provide a structure for organizing drawers and similar enclosed spaces, which overcomes these, and other drawbacks.

SUMMARY OF THE INVENTION

It is the primary object of the present invention to provide an organizing structure for drawers and other enclosed spaces, which is efficient and easy to use.

It is also an object of the present invention to provide an organizing structure for drawers and other enclosed spaces, which can be adjusted to precisely fit at least one dimension of the drawer so that space in the drawer is efficiently used. These and other objects and advantages of the invention will become more fully apparent from the description and claims, which follow, or may be learned by the practice of the invention Other objects and advantages of the present invention will become apparent from the following descriptions, taken in connection with the accompanying drawings, wherein, by way of illustration and example, an embodiment of the present invention is disclosed.

The present invention provides a versatile structure for segregating a plurality of items in an enclosed space, for example a drawer. The preferred embodiment of the present invention include a single blank of sheet material having an upper liner, a lower liner, and a filler sandwiched between said liners. The sheet material has a predetermined thickness, and the blank has opposed end edges. Parallel divider walls are formed in the blank adjacent floor panels by lower break lines in the sheet material, between respective pairs of parallel lower break lines, e.g., break lines are formed in the sheet material by a break through the lower liner, and the filler, but leaving the upper liner intact. The divider walls are defined between each such pair of break lines. The floor panels are divided from the wall portions by these parallel lower break lines and are defined between successive wall portions. Upper break lines or channels are formed midway between the parallel lower break lines. Upper break lines are formed by a break in the sheet material through the upper liner and filler but leaving the lower liner intact at respective upper break lines midway between the parallel lower break lines. A Channel is formed by a break in the lower liner and the filler approximately twice the thickness of the sheet material in width, at respective Channels midway between the parallel lower break lines. The blank can then be folded upwards at the parallel lower break lines and then folded downwards at the upper break lines or Channels to form double thickness divider walls with the floor panels extending between successive double thickness divider walls.

End walls, are formed by the first lower break lines in from either opposing end edges in the blank of sheet material. An end wall is defined between the first lower break line and the associated end edge. The blank is then folded upwards at the first lower break lines in from either opposing end edge to form a single thickness end wall.

The resulting structure can be adjusted in accordion fashion to the inside width of a drawer or other enclosure and then held in that shape by attaching front and back walls with an integrated brace portion to the front and back edges or the floor panels of the folded blank of sheet material. The brace portion is attached by the means of holding pins, adhesives, adhesive tape or other suitable connector.

Although Lower break lines, Upper break lines and Channels are used to help facilitate the folding of the blank of sheet material. Simply creasing and folding the sheet material in the same manner will achieve a similar structure. Furthermore, instead of the preferred blank of sheet material a series strips of any sheet material when hinged together in order to be folded in the same fashion would also create a similar structure.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
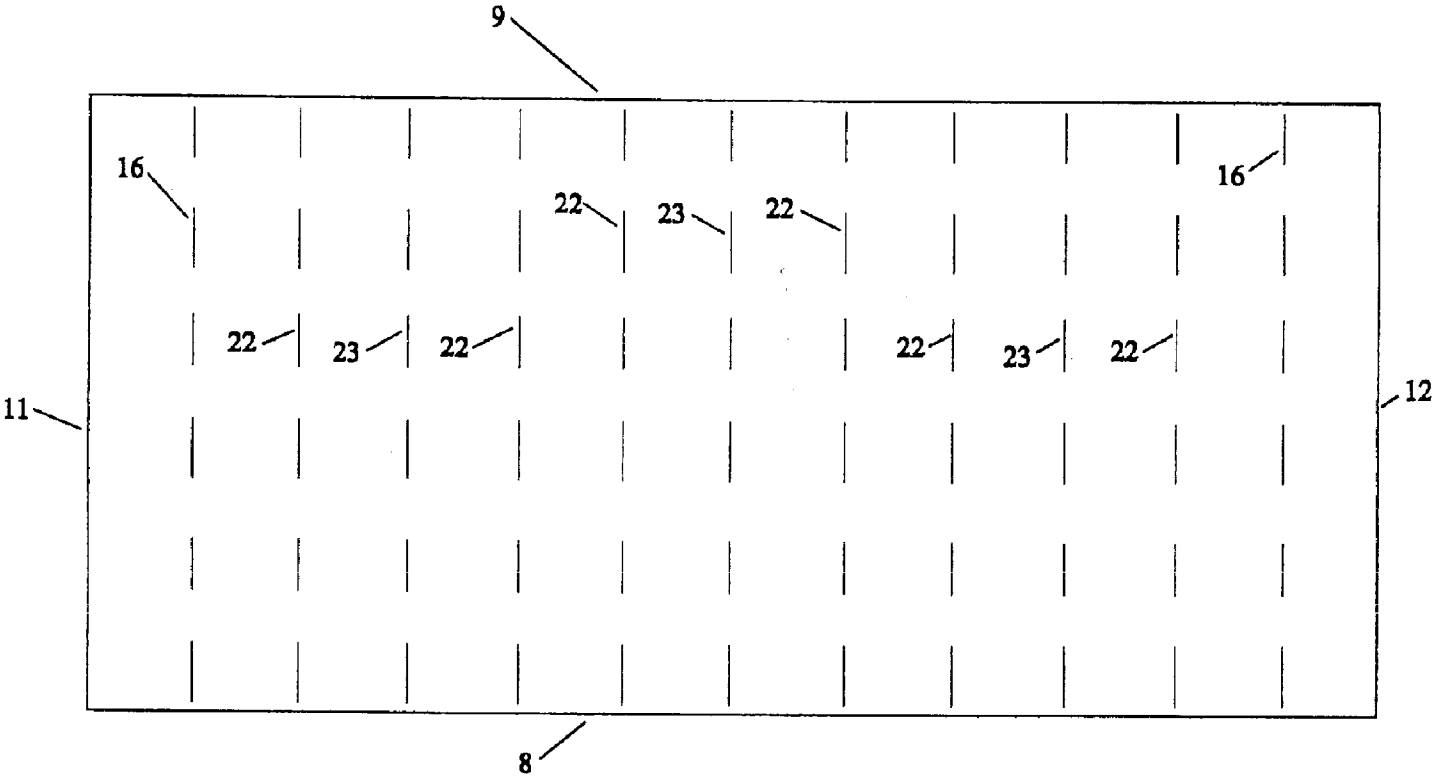
FIG. 1 is a plan view of a blank of corrugated sheet, for constructing an organizing structure according to one embodiment of this invention.

Reference will be first made to FIG. 1 thereof, a structure for the segregating of a plurality of items according to an embodiment of this invention, and a method of constructing it, involve a blank 10 of sheet material. The blank 10 has a first edge 11 and an opposite edge 12. As well as a front edge 8 and a rear edge 9.

Figure 2:
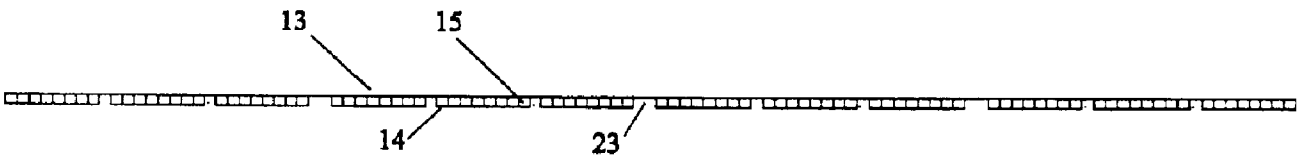
FIG. 2 is a cross-sectional view of a blank of corrugated sheet, for constructing an organizing structure according to an embodiment of this invention.

In the illustrated embodiment blank 10 is made of corrugated plastic; however, blank 10 can be made of any suitable sheet material. As shown in more detail in the cross-sectional elevation of FIG. 2, the blank material has a lower liner 14, a filler 15, and an upper liner 13. The filler 15 is sandwiched between the two liners 14 and 13.

As shown in the plan view of FIG. 1 the blank 10 has lower break lines 16 and 22 that run transversely through the sheet material were the lower liner and the filler material is missing while the upper liner is left intact. Furthermore, the blank 10 has channels 23 approximately the twice the width of the sheet material that run transversely through the sheet material were the lower liner and filler is missing while the upper liner is left intact. Break lines 16 are formed at transverse lines spaced in from each of the respective edges 11 and 12. Lower break lines 16 define end wall portions (FIG. 4, 19).

Also shown on FIG. 1 there are successive pairs of transverse lower break lines 22 spaced at intervals between the end wall portions (FIG. 4, 19) with channels 23 midway between the lower break lines 22 of each pair. Each pair of lower break lines 22 and its associated channel 23 define a divider wall portion (FIG. 4, 24), and floor panels (FIG. 4, 25) are defined between successive divider wall portions (FIG. 4, 24), and between each of the end wall portions (FIG. 4, 19) and adjacent divider wall portions (FIG. 4, 24). In this embodiment, there are two end wall portions (FIG. 4, 19) and three divider wall portions (FIG. 4, 24), forming four separate cells within the structure.

Figure 3:
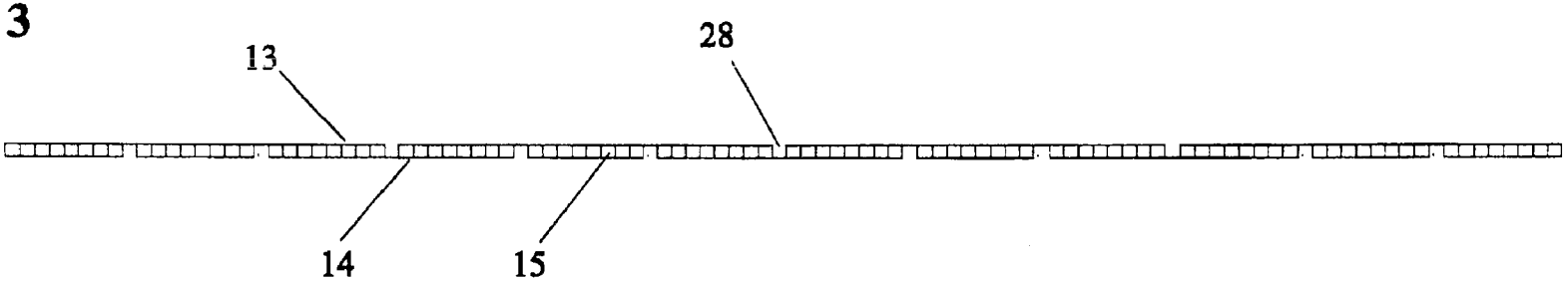
FIG. 3 is a cross-sectional view of a blank of corrugated sheet, for constructing an organizing structure according to an embodiment of this invention.

Although the channel (FIG. 2, 23) is used as the preferred method to help facilitate the folding of the blank of sheet material 10. As shown in FIG. 3 a upper break line 28 can also be used wherein the upper break line 28 runs transversely through the sheet material in which the upper liner 13 and the filler material 15 is missing while the lower liner 14 is left intact.

Figure 4:
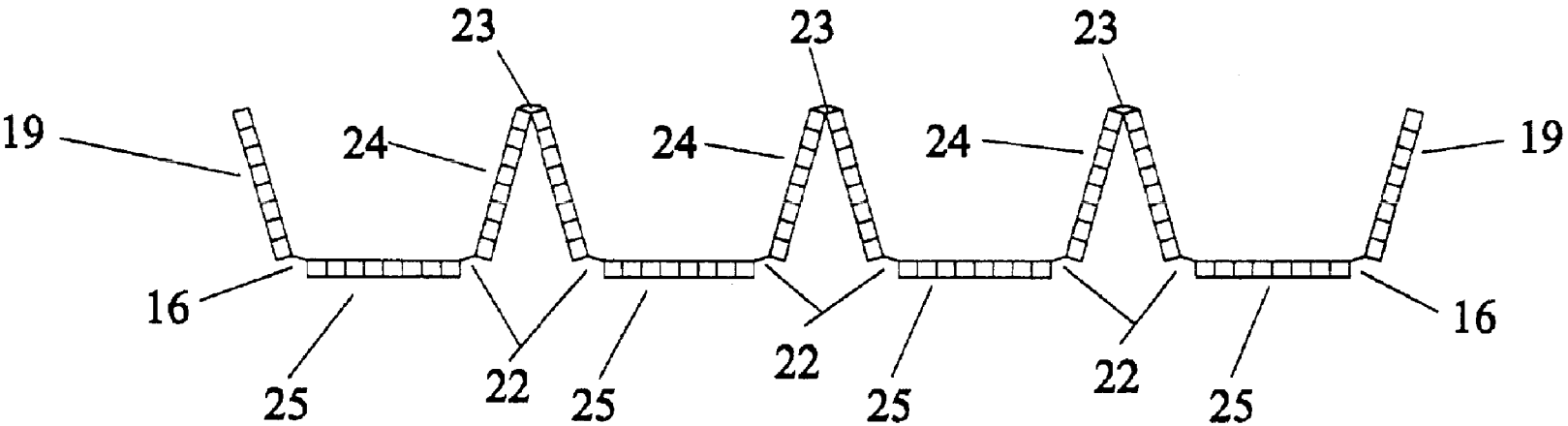
FIG. 4 is a cross-sectional view of a folded blank of corrugated sheet forming the organizing structure of this embodiment.
Figure 5:
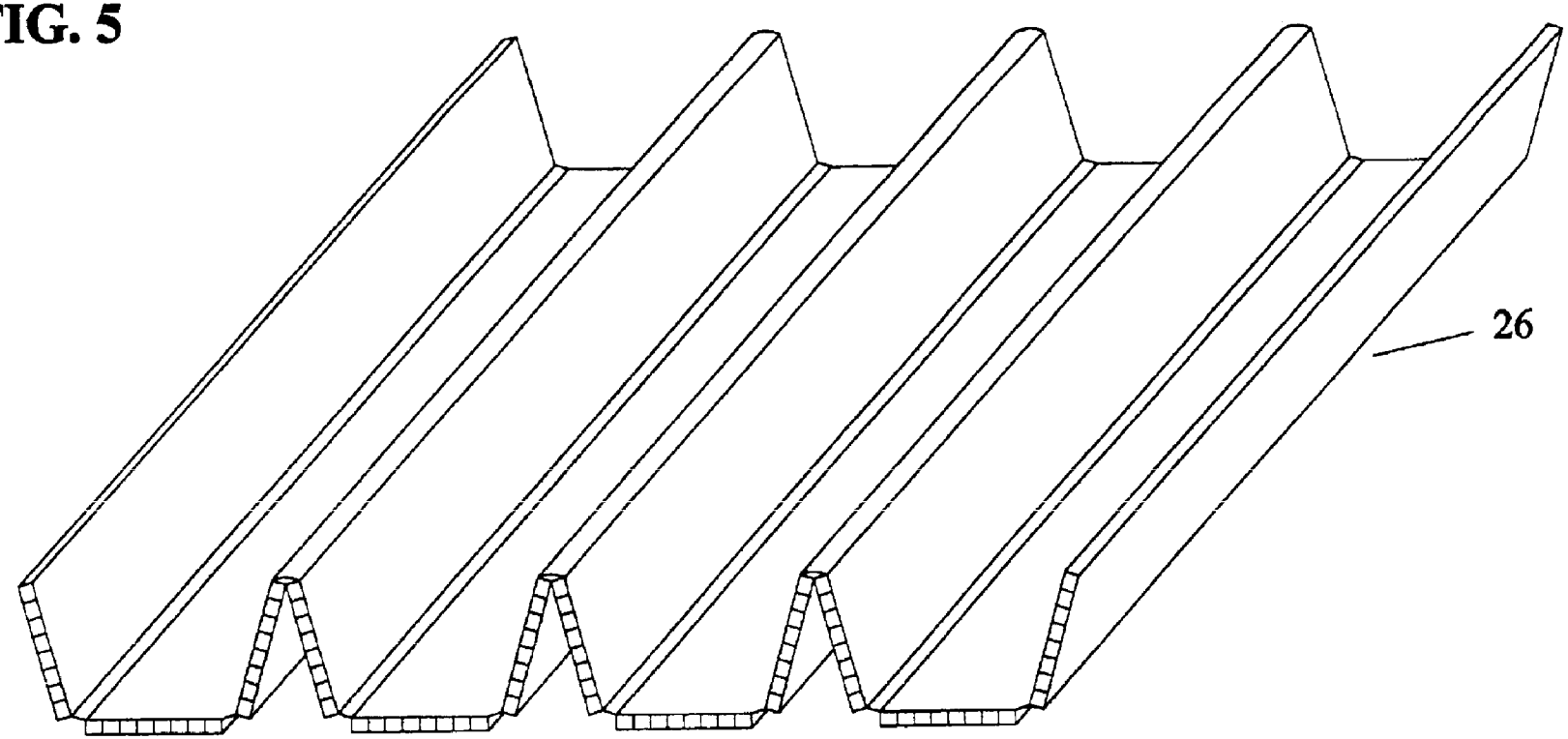
FIG. 5 is a perspective view of a folded blank of corrugated sheet forming the organizing structure of this embodiment.
Figure 10:
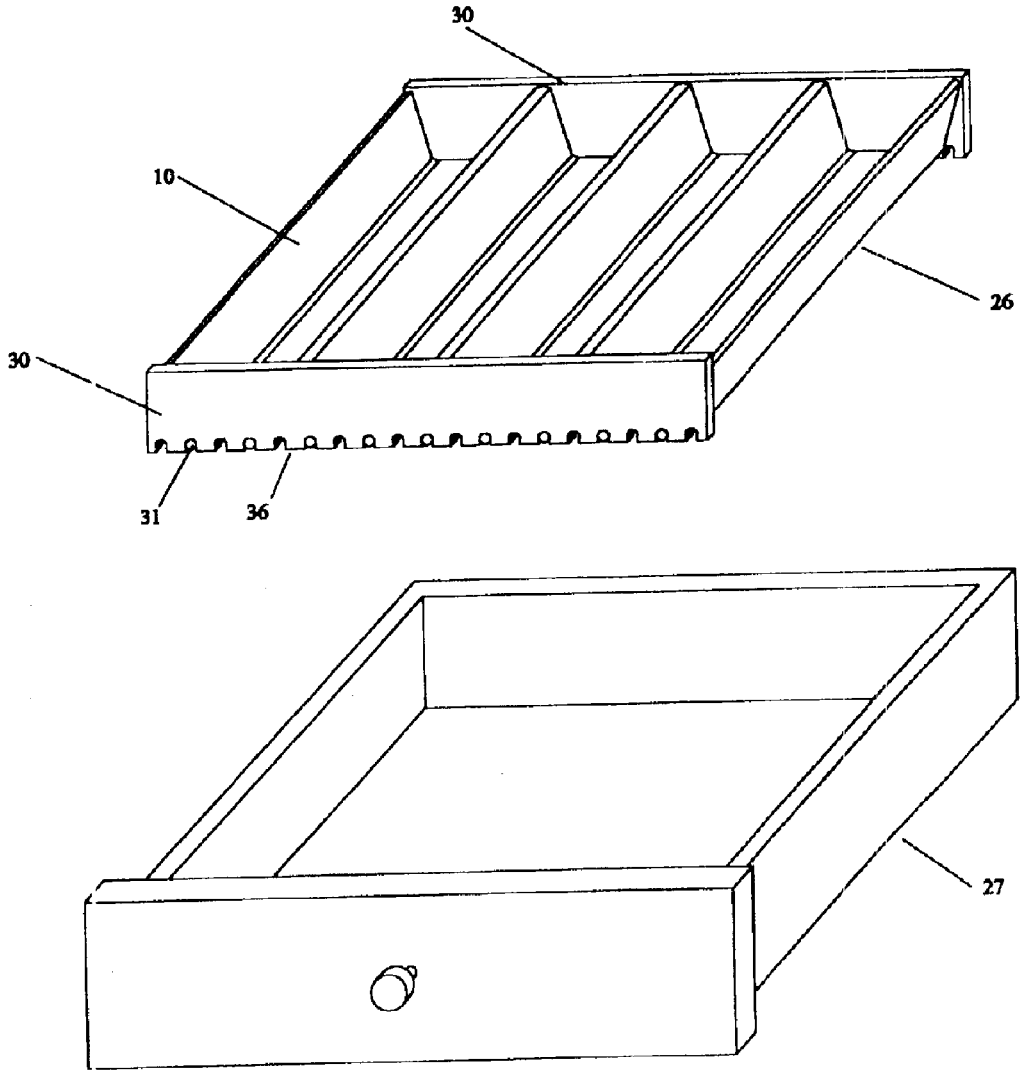
FIG. 10 is a perspective view of the first, presently preferred embodiment, of the present invention ready to be placed within a drawer.

A folded tray 26 is shown in the cross sectional view in FIG. 4 and in the perspective view in FIG. 5, with the blank (FIG. 1, 10) being folded or rolled at the lower break lines 16 and 22 and channels 23 to form the end walls 19 and divider walls 24 with the floor panels 25 separating these walls from one another. Additionally the lower break lines 16 and 22 and channels 23 permit the blank (FIG. 1, 10) to be folded in accordion fashion, and thereby, as shown in FIG. 10, permits the adjustment in width of the folded tray 26 to the width of the inside of a drawer 27 or other enclosure.

Although this embodiment uses the missing liner and filler material at transverse lower break lines, upper break lines and channels to help facilitate the folding of the sheet material into the desired shape. The same shape can be formed by leaving both liners (FIG. 2, 14), (FIG. 2, 13) and filler (FIG. 2, 15) intact and simply creasing and folding the sheet material at break lines (FIG. 1, 16) and (FIG. 1, 22) and channels (FIG. 1, 23) or upper break lines (FIG. 3, 28).

The blank (FIG. 1, 10) is bent upwards at the lower break lines 16 so that the end walls portions 19 project upwards, as shown in FIG. 4 The divider wall portions 24 are bent upwards at the lower break lines 22 and are bent downwards at the channels 23, this forms the divider walls 24. The height of the end walls 19 and the divider walls 24 as well as the width of the floor panels 25 can be selected as appropriate for a particular application.

Figure 6:
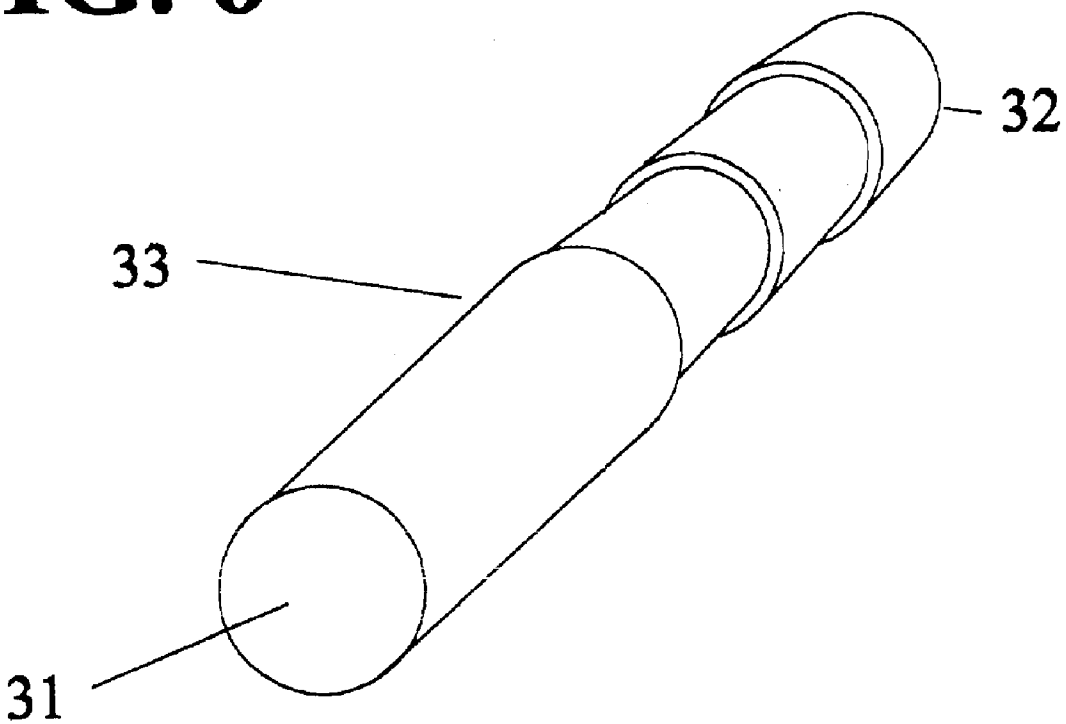
FIG. 6 is a perspective view of a holding pin.

As shown in FIG. 6 a holding pin 33 has forward end 32 and a rearward end 31. The forward end 32 is slightly larger in diameter than the thickness of the filler material (FIG. 2, 15) such that it can be tightly pushed into the filler space between the two liners (FIG. 2, 13) and (FIG. 2, 14) at the front edge (FIG. 1, 8) or the rear edge (FIG. 1, 9) holding it firmly in place leaving the rearward end 31 protruding from the front edge (FIG. 1, 8) or rear edge (FIG. 1, 9).

Figure 7:
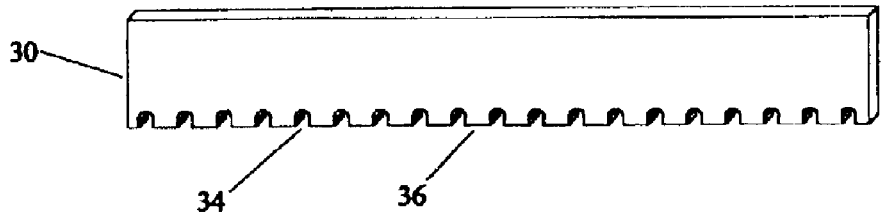
FIGS. 7, 8 and 9 are perspective views of three different embodiments of the front or back walls of the organizing structure according to an embodiment of this invention.
Figure 8:
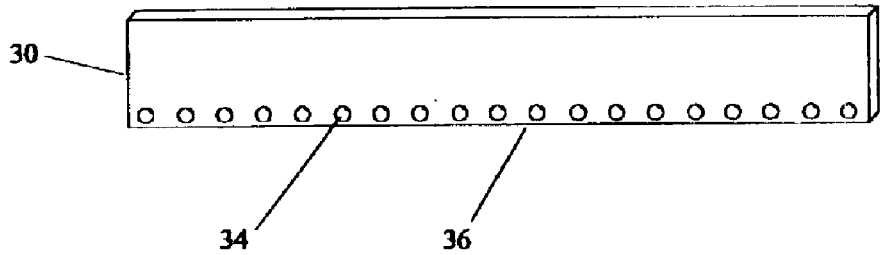

Two embodiments of the front or rear walls are shown in FIG. 7 and FIG. 8. The front or rear wall 30 have an integrated brace portion 36 that runs along the bottom edge of the front or rear wall 30. The brace portion 36 has a series of successive cavities 34, which are designed to receive and firmly hold the rearward end (FIG. 6, 31) of the holding pin (FIG. 6, 33). When several holding pins are installed in the floor panels (FIG. 4, 25) at the front edge (FIG. 1, 8) or rear edge (FIG. 1, 9) the front or rear walls 30 can be held firmly to the front and or rear edges by engaging the successive cavities 34 in the brace portion 36, to the protruding rearward ends (FIG. 6, 31) of the holding pin (FIG. 6, 33).

Figure 9:
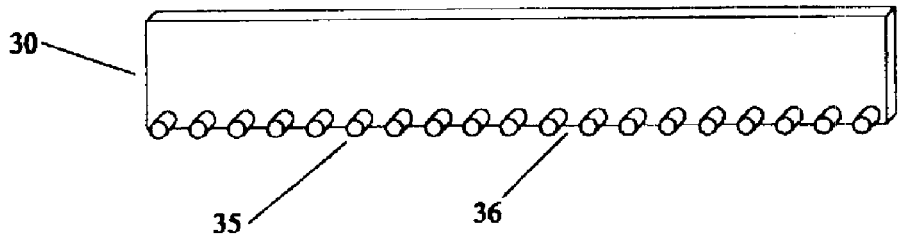

Another embodiment of the front or rear walls is shown in FIG. 9. In this case the front or rear wall 30 has a integrated brace portion 36 that runs along the bottom edge of the front or rear wall 30. The brace portion 36 has a series of successive integrated holding pins 35 which are slightly larger in diameter than the thickness of the filler material (FIG. 2, 15) such that they can be tightly pushed into the filler space between the two liners (FIG. 2, 13) and (FIG. 2, 14) at the front edge (FIG. 1, 8) or the rear edge (FIG. 1, 9) holding the front or rear wall firmly to the front edge (FIG. 1, 8) or rear edge (FIG. 1, 9).

Although these embodiments use a holding pin (FIG. 6,33) to hold the front and rear walls to the front edge (FIG. 1, 8) and the rear edge (FIG. 1, 9), any means of fastening can be used such as screws, adhesives or adhesive tape.

In FIG. 10 the present invention is shown fully assembled in the perspective view. The front and rear walls 30 have been cut to the width of the inside dimension of the drawer 27. The blank 10 has been folded and adjusted in accordion action to the same width and held in that shape by installing the forward end (FIG. 6, 32) of the holding pin (FIG. 6, 33) to the floor panels (FIG. 4, 25) at the front edge (FIG. 1, 8) and rear edge (FIG. 1, 9) of the blank 10, and engaging the protruding rearward end 31 to the brace portion 36 of the front and rear walls 30.

Figure 11:
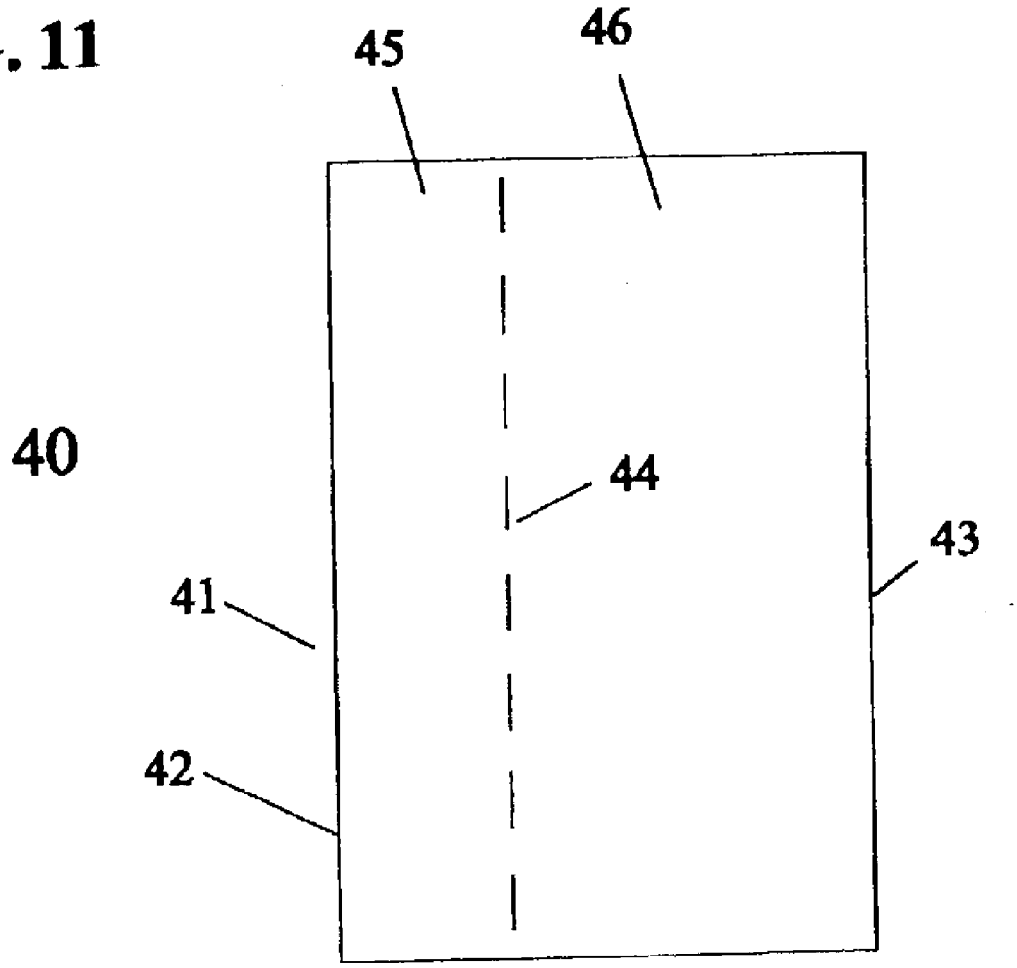
FIG. 11 is plan view of a blank of corrugated sheet, for constructing a front or back wall of an organizing structure according to an embodiment of this invention.

A plan view of another embodiment of the front or rear walls according to an embodiment of this invention is shown in FIG. 11. The front or rear wall 40, involve a wall blank of sheet material 41. The blank 41 has a first edge 42 and an opposite second edge 43.

Figure 12:
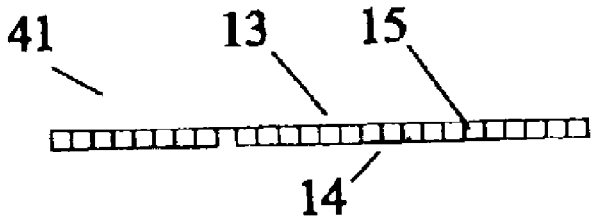
FIG. 12 is a cross-sectional view of a blank of corrugated sheet, for constructing a front or back wall of an organizing structure according to an embodiment of this invention.

In the illustrated embodiment wall blank 41 is made of corrugated plastic; however, wall blank 41 can be made of any suitable sheet material. As shown in more detail in the cross-sectional elevation of FIG. 12, the wall blank material has a lower liner 14, a filler 15, and an upper liner 13. The filler 15 is sandwiched between the two liners 14, 13.

As shown in the plan view of FIG. 1 the wall blank 41 has a lower break line 44 that runs transversely through the sheet material were the lower liner and the filler material is missing while the upper liner is left intact. Lower break line 44 is formed at a transverse line spaced in from the first edge 42 defining a front or rear wall portion 45. The remaining section between the lower break line 44 and the second edge 43 define a brace portion 46.

Figure 13:
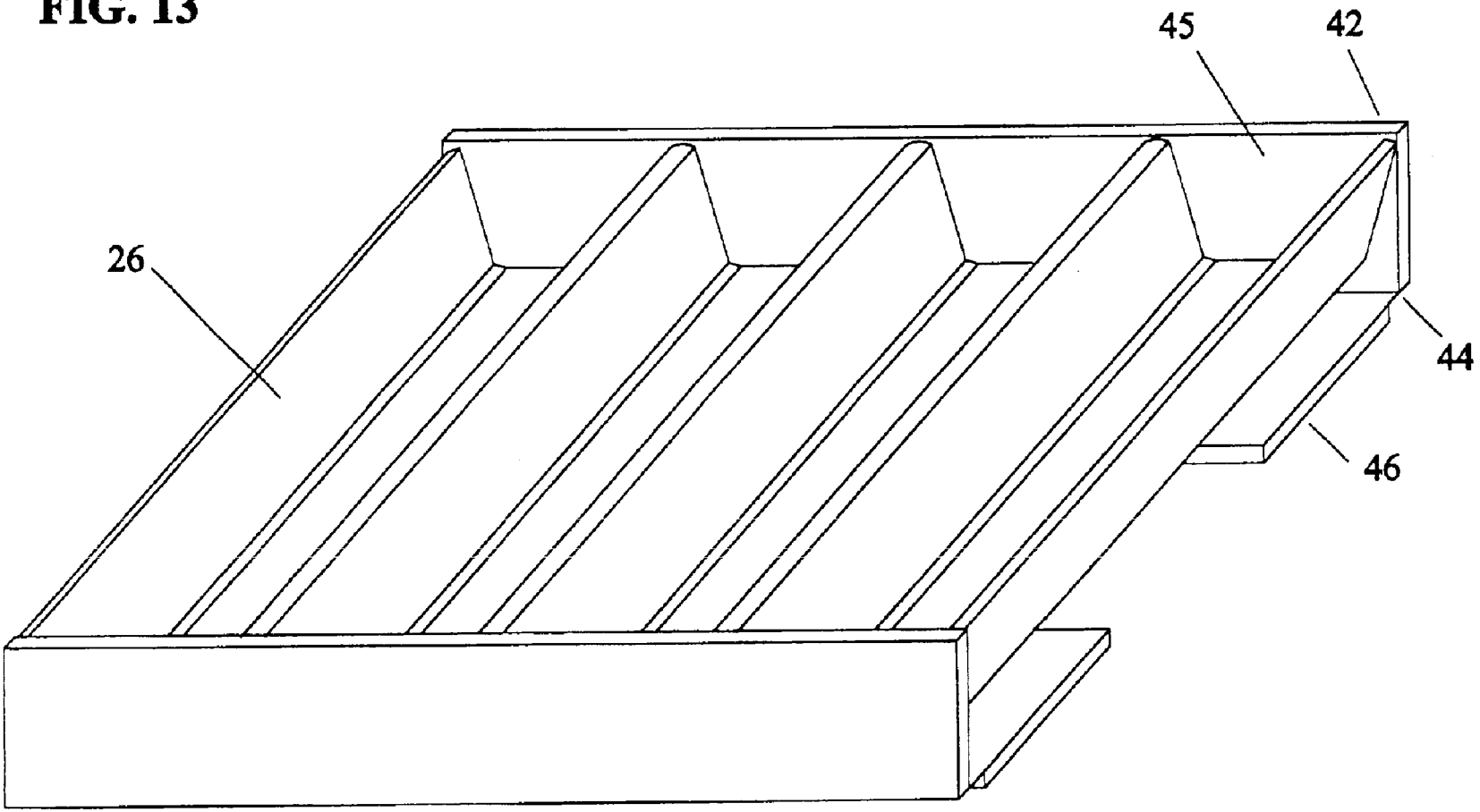
FIG. 13 is a perspective view of the second embodiment of the present invention.

The wall blank 41 is bent upwards at the break line 44 so that the front or rear wall portion 45 is projecting upwards, as shown in FIG. 13. The brace portion 46 is then attached to the folded tray 26, by the use of adhesive or double sided adhesive tape between the brace portion 46 and the floor panels (FIG. 4, 25).

Figure 14:
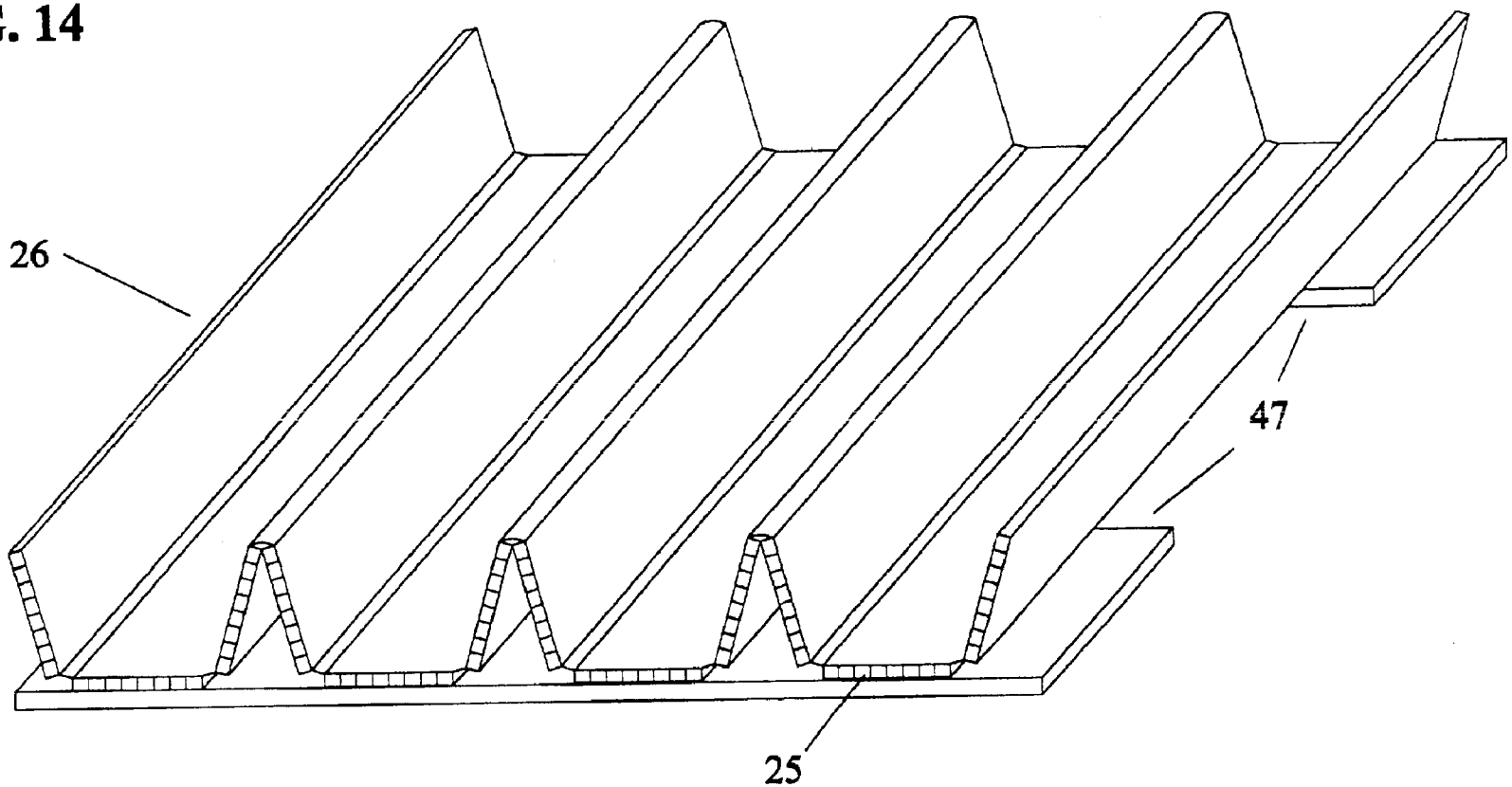
FIG. 14 is a perspective view of the third embodiment of the present invention.

In FIG. 14 a third embodiment of the present invention is shown in the perspective view. In this embodiment the folded tray 26 is adjusted in accordian action and held in that shape by attaching a brace 47 to the floor panels 25. The brace consists of a strip of sheet material cut to the desired width and is attached to the floor panels with adhesive or double-sided adhesive tape between the floor panels 25 and the brace 47.

Figure 15:
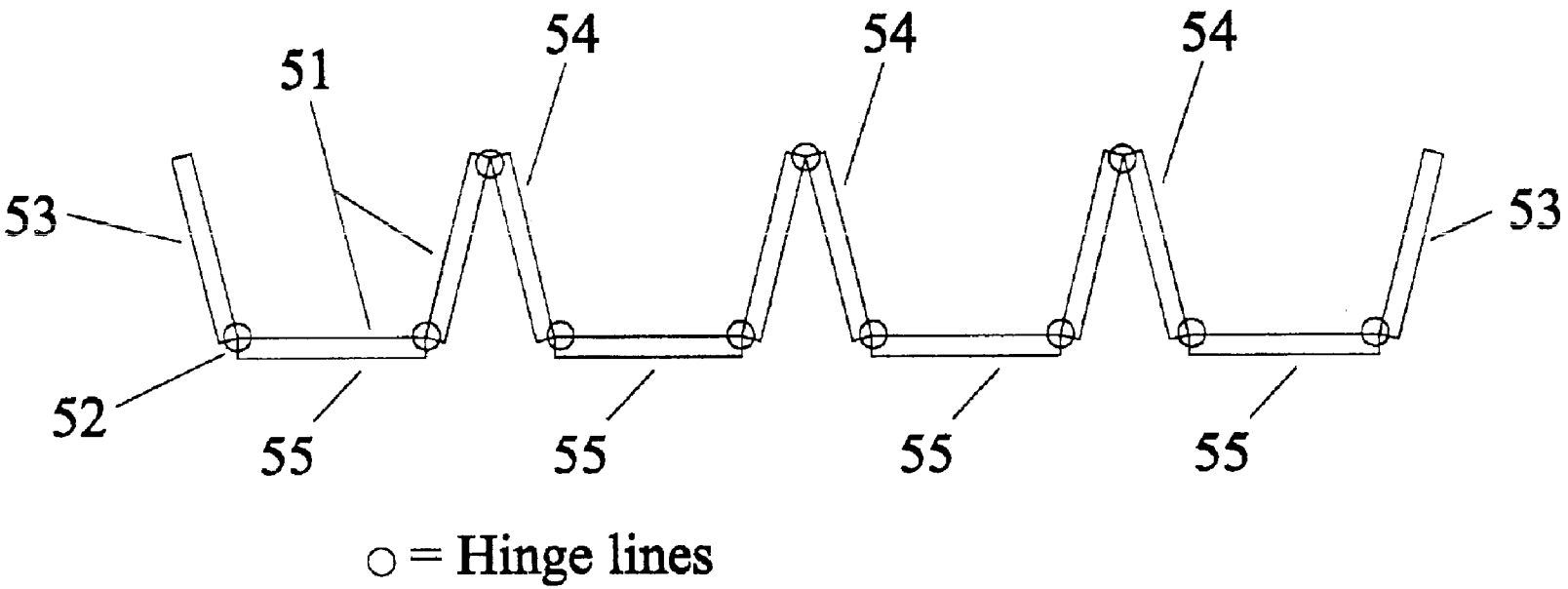
FIG. 15 is a cross -sectional view of several strips of sheet material hinged together to form an organizing structure according to an embodiment of this invention.

Although this embodiment uses the missing liner and filler material at transverse break lines to help facilitate the folding of the sheet material into the desired shape. As shown in FIG. 15 a similar strucure can be formed by using strips of any sheet material 51 hinged together at hinge lines in order to be folded in similar fashion.

Figure 16:
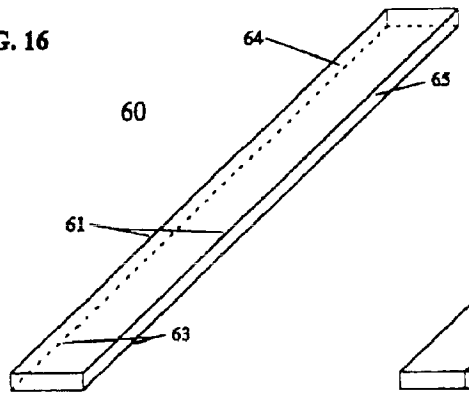
FIG. 16 is a perspective view of a strip of sheet material, for constructing a hinged sheet according to an embodiment of this invention.

In FIG. 16 a single strip of sheet material 60 is shown in the perspective view with upper hinge edges 61, lower hinge edges 63, a first edge 64 and a second edge 65. In order to form a single hinged sheet (FIG. 17, 66) as shown in FIG. 17, several strips of sheet material 60 are hinged together in which the first edge 64 of one strip of sheet material is hinged to the second edge 65 of the adjacent strip of sheet material 60.

Figure 17:
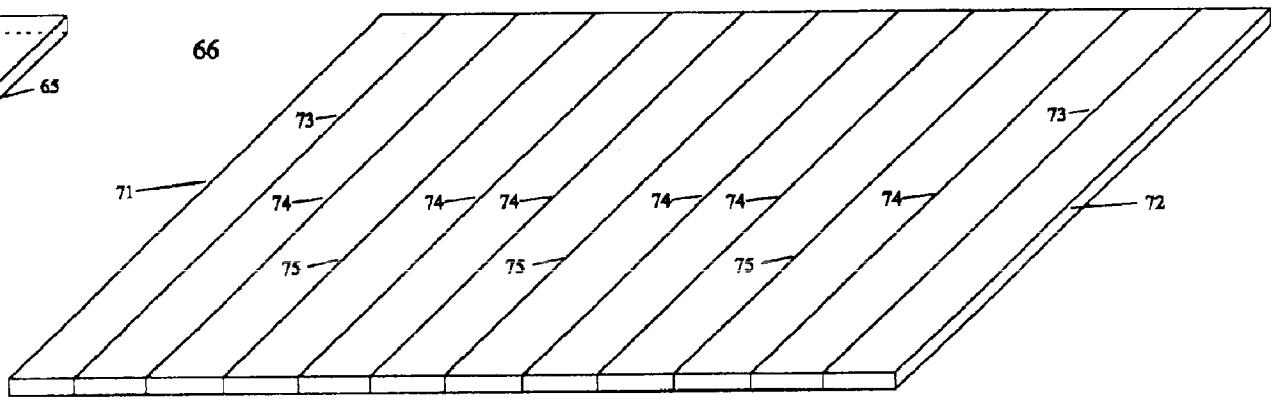
FIG. 17 is a perspective view of a hinged sheet for constructing an organizing structure according to an embodiment of this invention.

As shown in FIG. 17 a hinged sheet 66 has opposing end edges 71 and 72, upper hinge lines 73 and 74, and lower hinge lines 75. Upper hinge lines 73 and 74 are formed by hingeing the upper hinge edge (FIG. 16, 61) of a strip of sheet material (FIG. 16, 60) to the upper hinge edge (FIG. 16, 61) of another strip of sheet material (FIG. 16, 60). Lower hinge lines 75 are formed by hingeing the lower hinge edge (FIG. 16, 63) of a strip of sheet material (FIG. 16, 60) to the lower hinge edge (FIG. 16, 63) of another strip of sheet material (FIG. 16, 60). Upper hinge lines 73 are formed at transverse lines spaced in from each of the respective edges 71 and 72 defining end wall portions (FIG. 15, 53). Also shown in FIG. 17 there are successive pairs of transverse upper hinge lines 74 spaced at intervals between the end wall portions (FIG. 15, 53) with the lower hinge line 75 midway between the upper hinge lines 74 of each pair. Each pair of upper break lines 74 and its associated lower hinge line 75 define a divider wall portion (FIG. 15, 54), and floor panels (FIG. 15, 55) defined between successive divider wall portions (FIG. 15, 54), and between each of the end wall portions (FIG. 15, 53) and the adjacent divider wall portions (FIG. 15, 54). In this embodiment, there are two end wall portions (FIG. 15, 53) and three divider wall portions (FIG. 15, 54), forming four separate cells within the structure.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An apparatus for segregating a plurality of items from a single blank of sheet material having an upper liner, a lower liner, and a filler sandwiched between said liners, and said sheet material having a predetermined thickness, and said blank having opposing end edges, a front edge and a back edge; said apparatus adapted to be disposed on the inside bottom of a drawer having an inside width, an inside depth, and an inside height; the apparatus comprising;

at least one double thickness divider wall adjacent a floor panel is formed by lower break lines in said sheet material through said lower liner and said filler but leaving said upper liner intact at two parallel lower break lines with said divider wall being defined there between and said floor panel being separated by said parallel lower break lines from said divider wall portion; a channel in said sheet material through said lower liner and said filler but leaving said upper liner intact midway between and parallel to said parallel lower break lines;

folding said blank upwards at said parallel lower break lines and folding said blank downwards at said channel to form said double thickness divider wall with said floor panel extending from each side thereof;

a brace running perpendicular to divider wall, said brace with a means of attachment to said folded sheet material holding the said sheet material to its folded shape.

2. The apparatus for segregating a plurality of items from a single blank of sheet material having an upper liner, a lower liner, and a filler sandwiched between said liners, and said sheet material having a predetermined thickness, and said blank having opposing end edges, a front edge and a back edge, said apparatus adapted to be disposed on the inside bottom of a drawer having an inside width, an inside depth, and an inside height, the apparatus as claimed in claim 1 further comprising;

front and back walls running perpendicular to divider walls, said front and back walls with a means of attachment to said front and back edge of said sheet material.

3. The apparatus for segregating a plurality of items from a single blank of sheet material having an upper liner, a lower liner, and a filler sandwiched between said liners, and said sheet material having a predetermined thickness, and said blank having opposing end edges, a front edge and a back edge, said apparatus adapted to be disposed on the inside bottom of a drawer having an inside width, an inside depth, and an inside height, the apparatus as claimed in claim 1 further comprising;

end walls that are formed by a lower break line in said sheet material through said lower liner and filler of said sheet material but leaving said upper liner intact at a break line spaced from said end edges;

folding said blank upwards at lower break line to form a single thickness end wall.

4. The apparatus for segregating a plurality of items from a single blank of sheet material having an upper liner, a lower liner, and a filler sandwiched between said liners, and said sheet material having a predetermined thickness, and said blank having opposing end edges, a front edge and a back edge, said apparatus adapted to be disposed on the inside bottom of a drawer having an inside width, an inside depth, and an inside height, the apparatus as claimed in claim 1 wherein; the brace comprises a wall blank formed from a single blank of sheet material having an upper liner, a lower liner, and a filler sandwiched between said liners, and said sheet material having a predetermined thickness, and said wall blank having opposing first and second edges, said wall blank has a lower break line that runs transversely through said sheet material were the said lower liner and said filler is missing while said upper liner is left intact, said lower break line is folded upwardly defining an upright wall of the brace between the lower break line and the first edge and the section of the brace between the lower break line and the second edge defining a base wall of the brace.

5. The apparatus of claim 1 wherein the means of attachment of the brace includes integrated holding pins.

6. The apparatus of claim 1 wherein the means of attachment of the brace includes through holes.

7. The apparatus of claim 1 wherein the means of attachment of the brace includes notches in a lower edge.

* * * * *